US009309088B2

(12) United States Patent
Witherbee

(10) Patent No.: US 9,309,088 B2
(45) Date of Patent: Apr. 12, 2016

(54) CABLE MANAGEMENT DEVICE

(71) Applicant: Cooper Technologies Company, Houston, TX (US)

(72) Inventor: Martin Witherbee, Godfrey, IL (US)

(73) Assignee: Cooper Technologies Company, Highland, IL (US)

( * ) Notice: Subject to any disclaimer, the term of this patent is extended or adjusted under 35 U.S.C. 154(b) by 177 days.

(21) Appl. No.: 13/741,039

(22) Filed: Jan. 14, 2013

(65) Prior Publication Data

US 2014/0197261 A1 Jul. 17, 2014

(51) Int. Cl.
*B65H 75/20* (2006.01)
*B65H 75/44* (2006.01)

(52) U.S. Cl.
CPC ..... *B65H 75/4476* (2013.01); *B65H 2701/34* (2013.01)

(58) Field of Classification Search
USPC ..... 242/118.41, 604, 604.1, 607, 608.2, 242/608.6, 609.1, 613, 578, 578.2, 118.61
See application file for complete search history.

(56) References Cited

U.S. PATENT DOCUMENTS

| | | | | |
|---|---|---|---|---|
| 2,527,520 | A * | 10/1950 | Bliss | 242/118.61 |
| 3,717,315 | A * | 2/1973 | Kovaleski | 242/609.1 |
| 5,004,179 | A * | 4/1991 | Salloum | 242/118.6 |
| 5,894,540 | A | 4/1999 | Drewing | |
| 5,971,317 | A * | 10/1999 | Jaros | 242/614 |
| 6,361,360 | B1 | 3/2002 | Hwang et al. | |
| 6,783,093 | B2 * | 8/2004 | Limber | 242/405.2 |
| 7,588,210 | B2 * | 9/2009 | Hafner | 242/609 |
| 7,614,582 | B2 * | 11/2009 | Hafner | 242/609 |
| 2001/0032727 | A1 | 10/2001 | Maynard et al. | |
| 2012/0111809 | A1 | 5/2012 | Smith et al. | |

FOREIGN PATENT DOCUMENTS

| | | | |
|---|---|---|---|
| KR | 10-2005-0019648 | A | 3/2005 |
| WO | WO 2011/100545 | A1 | 8/2011 |

OTHER PUBLICATIONS

PCT Application PCT/US2014/011533; filing date Jan. 14, 2014; International Search Report mailed May 8, 2014.
2 Spools on 2RU Panel—MA-PCS-3-2H; 1 page; Jan. 23, 2011.
Dimension Cable Spool Panel—MA-PCS-x-2H; 1 page; Jan. 23, 2011.
V-Line™ Cabinet Systems, Next generation, VLNGCD-10; 28 pages; Jan. 2010; Cooper B-Line.
Comm/Data Equipment Supports, BLCOMD-11; 348 pages; Jan. 2011; Copper B-Line.
Cable Tray Systems, CT-10; 460 pages; Jan. 2010; Cooper B-Line.

* cited by examiner

*Primary Examiner* — Sang Kim
(74) *Attorney, Agent, or Firm* — Senniger Powers LLP

(57) ABSTRACT

A cable management device is disclosed. The cable management device includes a first component and a second component, each component having a spooling portion to receive a cable, a flange extending from the spooling portion to maintain the cable on the spooling portion, and a coupling feature operable to facilitate coupling of the first component and the second component. The first component and the second component are configured to interface with one another such that the respective spooling portions mate to form a spool for the cable.

20 Claims, 9 Drawing Sheets

CABLE MANAGEMENT DEVICE

BACKGROUND

Many commercial and other buildings have communication or data rooms that house central communication equipment for the building or offices within the building. Often, hundreds or thousands of feet of cable, such as data, electrical, telephone, or other cables, are routed to and contained in such rooms. To assist in organization and maintenance, it is typically desirable to incorporate some type of cable management solution. Without such a solution, and as it is often necessary or desired that additional cables be routed, or existing cables moved, or removed, these cables can therefore easily become tangled or otherwise unmanageable and difficult to work with. Such tangled cables are commonly known as "cable spaghetti," which can make adding, moving, or removing cables difficult and time consuming. In some cases, cables can inadvertently be unplugged from various devices, thus creating further difficulties in maintaining functional communication equipment. In addition, inefficiently managed cables can put a burden on hardware by restricting airflow and ventilation within a data room or near a hardware enclosure, which can cause hardware to run hot or overheat.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1A:
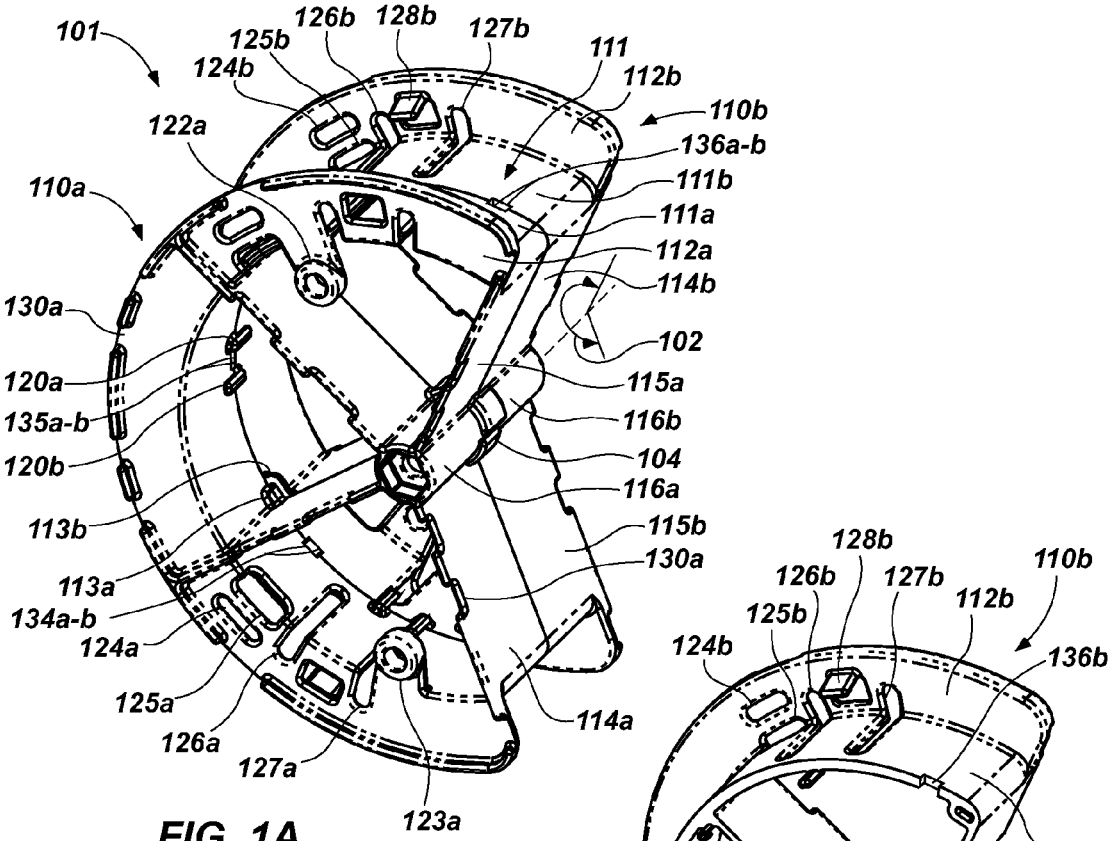
FIG. 1A is an example illustration of a cable management device in accordance with an embodiment of the present invention.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

To manage cables within a data, communication room, or any other type of room (generally referred to as a data room) in which cables are routed, the cables are often looped and stored in cable trays or on cable runways and/or secured with cable ties. Although such techniques can be somewhat effective for managing cables, a loop of cable may become lost among other loops of cable in a cable tray, and severing and/or securing numerous cable ties can make accessing or adding a cable a tedious task.

Accordingly, a cable management device is disclosed that facilitates wrapping a cable around a spool to enhance cable management efficiency and effectiveness, and that can also facilitate enhanced airflow and ventilation for hardware in a data room. In one aspect, the cable management device can be mounted to a support structure, such as a wall, a wire tray, or a cable runway. Although these types of support structures are typically flat or generally planar in configuration, other types and configurations of support structures are contemplated herein.

As shown and described herein, the cable management device can include a first component and a second component. At least one, and in some embodiments each, component can have a spooling portion to receive a cable, a flange extending from the spooling portion to maintain the cable on the spooling portion, and a coupling feature operable to facilitate coupling of the first component and the second component. The first component and the second component can be configured to interface and mate with one another. In the embodiment where both component halves are similar in configuration and comprise similar elements, the components can interface and mate, such that the respective spooling portions mate to form a spool for the cable.

A first component of a cable management device is disclosed, which component is configured to interface with and mate with a second adjoining or associated cable management device component. The cable management device component can include a spooling portion to receive a cable, a flange extending from the spooling portion to maintain the cable on the spooling portion, and a coupling feature operable to facilitate mating with the second cable management device component to form a cable management device.

A cable management device is further disclosed. The cable management device can include two mating cable management device components coupled to one another, at least one or each component having a spooling portion to receive a cable. At least one of the cable management device components can include a flange on an outer side of the component to maintain the cable on the spooling portion.

A cable management system is still further disclosed. The system can include a support structure, and a plurality of cable management devices mounted to the support structure. The plurality of cable management devices can be positioned and oriented relative to one another to provide a customized cable support profile.

Figure 1B:
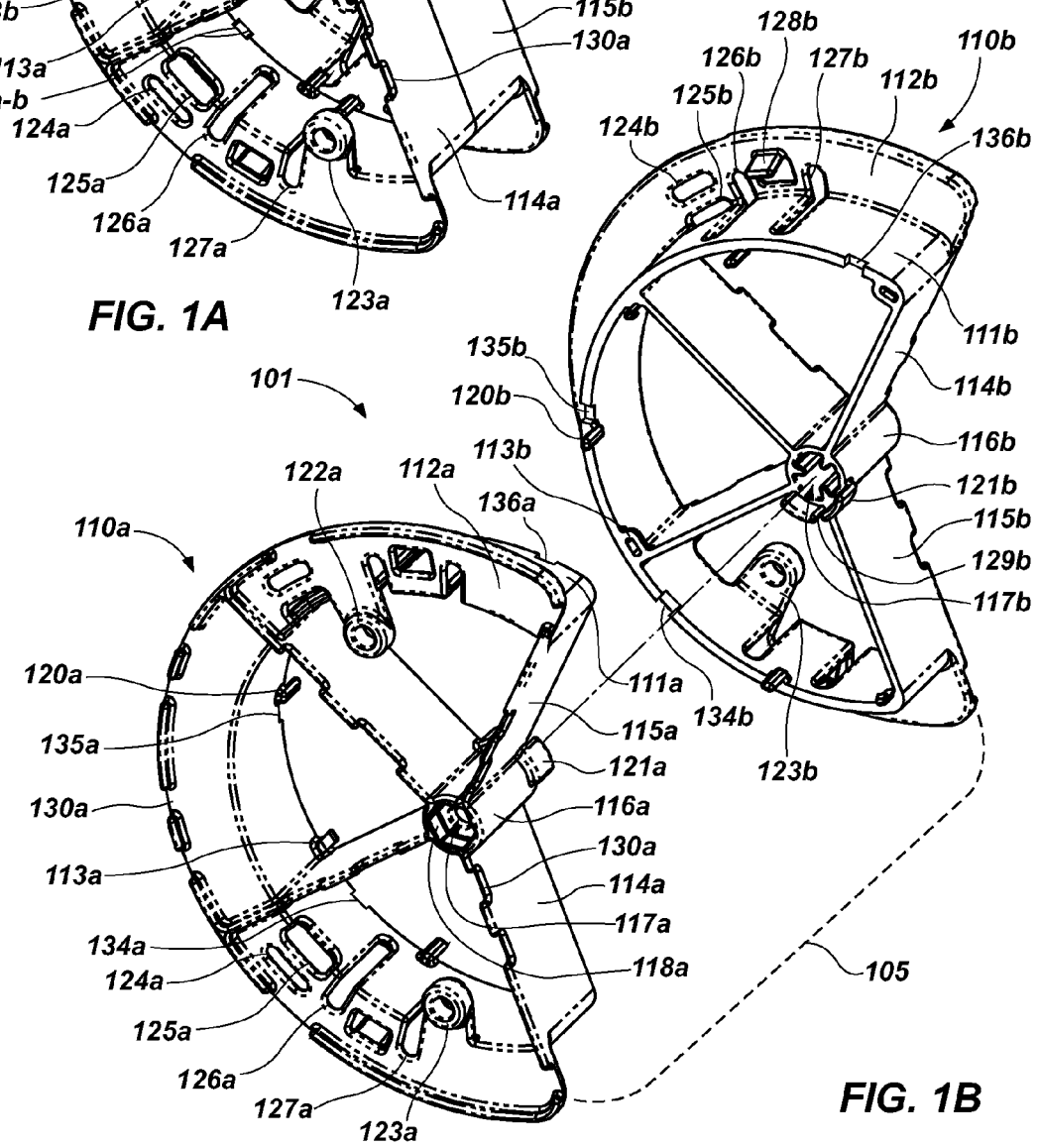
FIG. 1B is an exploded view of the cable management device of FIG. 1A.

With reference to FIGS. 1A and 1B, illustrated is one exemplary embodiment of a cable management device. The cable management device 101 can comprise a first component 110*a* and a second component 110*b* that are configured to be coupleable to, and that can be coupled to, one another. One advantage of the first and second components 110*a*, 110*b* is that the separate components can be inexpensively manufactured and assembled to form the cable management device 101. For example, the first and second components 110*a*, 110*b* can be molded, such as injection molded. As will be recognized, the two components 110*a*, 110*b* can be configured, such that assembly of the first and second components 110*a*, 110*b* can be caused to be simple, thus allowing a technician to perform the task in the field without special tools or training and even in low light environments. In one aspect, prior to assembly, the first and second components 110*a*, 110*b* can have a disposable tether 105 connecting the two components 110*a*, 110*b* so that a mating pair is provided for quick and easy assembly. This can be beneficial when the technician is grabbing components out of a box of unassembled cable management device components.

The cable management components 110*a*, 110*b* can have a spooling portion 111*a*, 111*b* to receive and support a cable and a flange 112*a*, 112*b* extending from the spooling portion 111*a*, 111*b* to maintain the cable on the spooling portion 111*a*, 111*b*. For example, the flange 112*a* can be formed on an outer side of the first component 110*a* to maintain the cable on the spooling portion 111*a*. The spooling portions 111*a*, 111*b* (and the resulting formed spool) can be generally circular in its cross-sectional shape, although other configurations may be possible, as described below.

The cable management components 110*a*, 110*b* can also include a coupling feature 113*a*, 113*b* operable to facilitate coupling of the first component 110*a* and the second component 110*b*. In one aspect, the coupling feature 113*a*, 113*b* can comprise a protrusion 113*a* and an opening 113*b* configured to receive the protrusion 113*a*. In another aspect, the coupling feature 113*a*, 113*b* can comprise at least one of a hook, a receiver, a loop, a tab, an opening, a catch, a clasp, a latch, a detent, and combinations thereof. In another aspect, the coupling feature 113*a*, 113*b* can form a permanent or a removable coupling. As illustrated, the coupling feature 113*a*, 113*b* is disposed proximate to the spooling portion 111*a*, 111*b*, however, it should be recognized that the coupling feature 113*a*, 113*b* can be disposed in any suitable location. The coupling feature 113*a* (illustrated as a protrusion) of the first component 110*a* can therefore be operable to facilitate mating with the coupling feature 113*b* (illustrated as an opening sized and configured to receive and retain or couple the protrusion) to form the cable management device 101. Thus, the first component 110*a* and the second component 110*b* can be configured to interface with one another such that the respective spooling portions 111*a*, 111*b* mate to form a spool 111 supportive of a cable.

In one aspect, the first component 110*a* and the second component 110*b* can be identical in configuration, such as two identical halves used to form the cable management device 101. It should be recognized, however, that a first component and a second component can be different from one another and need not be identical (e.g., need not form a half of a cable management device).

Figure 2:
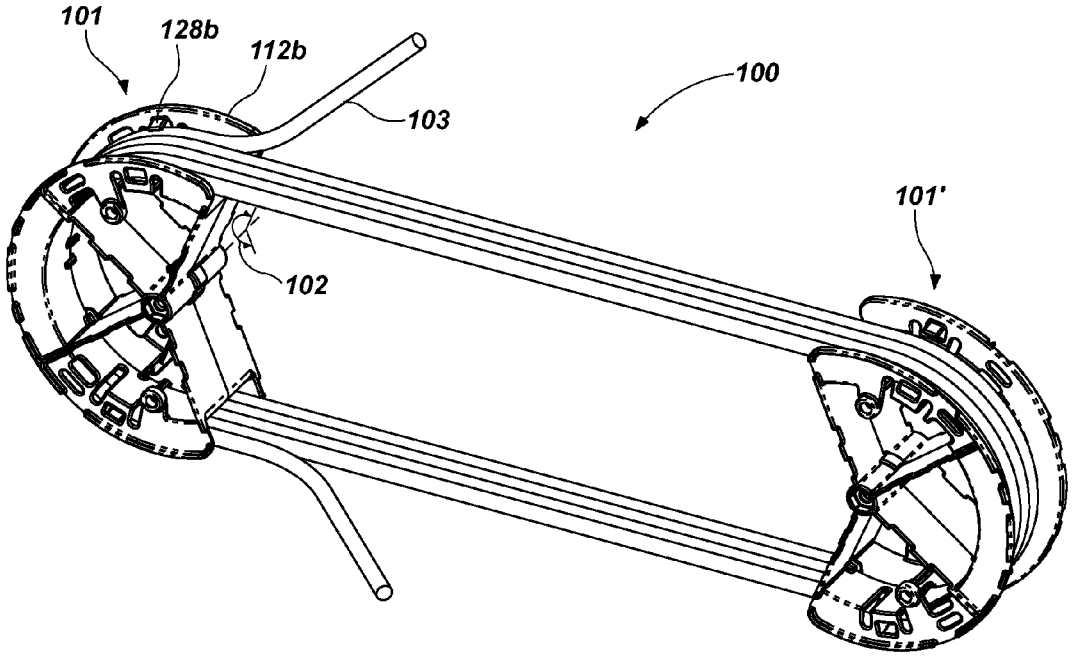
FIG. 2 is an example illustration of a cable management system in accordance with an embodiment of the present invention.

The spool 111 (and therefore the spooling portion or portions) can be of any suitable size and shape. In one aspect, the spool 111 can be sized and/or shaped to maintain a proper bend radius of the cable when wrapped around the spool 111 to prevent damaging the cable. In another aspect, the spool 111 need not extend a full 360 degrees and may be configured, instead, to extend sufficient to provide a usable surface for the cable to wrap around. For example, as illustrated, the spool 111 comprises a semi-cylindrical configuration extending to an angle 102 of at least 180 degrees and less than 360 degrees, wherein a spool break (the circumferential gap between the spool surfaces beginning at one spool edge and ending at the opposing spool edge) is defined. As shown in cable management system 100 of FIG. 2, the spool angle 102 can be greater than 180 degrees (with the spool break being less than 180 degrees) to allow for a certain amount of rotational and/or orientational misalignment between two cable management devices 101, 101' that operate together to support a cable while still providing working spool surfaces for the cable 103. Having the angle 102 greater than 180 degrees can therefore make alignment of the cable management devices 101, 101' more flexible because no edge is presented for the cable to contact when the devices 101, 101' are slightly misaligned. Indeed, the spool edges are positioned such that they are below or inside the imaginary planes defined by the first or initial row of cable wrapped about and extending from and between the spools. In addition, FIG. 2 illustrates the cable management devices 101, 101' oriented relative to one another to provide a "linear" cable support profile. Cable support profiles are discussed in more detail hereinafter with reference to FIGS. 7A-7C.

With further reference to FIGS. 1A and 1B, the cable management components 110*a*, 110*b* can each have a plurality of spokes, such as spokes 114*a*, 115*a*, 114*b*, 115*b*, and a hub 116*a*, 116*b* in support of the spooling portions 111*a*, 111*b*, respectively. In another aspect, the spooling portion 111*a*, 111*b* can comprise a rim configuration. A hub, spoke, and/or rim can reduce the material needed to construct the cable management device 101. The hub 116*a*, 116*b* can also be configured to receive a fastener for securing the cable management device components 110*a*, 110*b* and/or mounting the cable management device 101 to a support structure. For example, the hub 116*a*, 116*b* can include a hole 117*a*, 117*b* to receive a fastener, which can extend through both hubs 116*a*, 116*b* when the cable management device components 110*a*, 110*b* are mated to one another. In addition, the hole 117*b* of the second component 110*b* in FIG. 1B illustrates that one or more ribs 119*b* or protrusions can be formed in the hole to guide the fastener through the hole 117*b*. Such ribs or protrusions can be advantageous to reduce material and wall thickness in the hub while maintaining the guiding functionality of the hole for the fastener. Furthermore, the hub 116*a* of the first component 110*a* in FIG. 1B illustrates that the hub 116*a* can include a recess 118*a* configured to receive a head or nut of the fastener to facilitate securing the first and second components to one another and/or mounting the cable management device 101 to a support structure.

As further illustrated, the cable management components 110*a*, 110*b* can also include one or more alignment features to guide the first component 110*a* and the second component 110*b* into proper alignment when coupling to one another. In one aspect, an alignment feature 120*a*, 120*b* can be disposed on the spooling portion 111*a*, 111*b*, such as proximate to an underside of the rim, and configured to engage the mating rim. For example, the alignment feature 120*a*, 120*b* can comprise a protrusion extending from an inner side of the rim to guide the mating rim into alignment to facilitate mating and coupling the first and second components 110*a*, 110*b*. In addition, the alignment features 120*a*, 120*b* can be configured to be radially offset from one another to avoid interference between the alignment features 120*a*, 120*b* when coupling the first and second components 110*a*, 110*b*.

In another aspect, an alignment feature 121*a*, 121*b* can be disposed on or proximate to the hub 116*a*, 116*b* to facilitate mating and coupling of the cable management device components 110*a*, 110*b*, such as by engaging the mating hub and at least one spoke. For example, the alignment feature 121*a*, 121*b* can comprise one or more protrusions from an inner side of the hub 116*a*, 116*b* that are configured to surround at least a portion of the mating hub in order to guide the mating hub into alignment when coupling the first and second components 110*a*, 110*b*. In one aspect, the alignment feature 121*a*, 121*b* can have an opening 129*b*, such as a slot or gap, to receive a mating spoke when coupling the first and second components 110*a*, 110*b*. In another aspect, the alignment features 121*a*, 121*b* can be configured to engage one another, such as along interfacing sides (indicated by 104 in FIG. 1A), when mating and coupling the cable management components 110*a*, 110*b*. Thus, the alignment feature 121*a*, 121*b* can be configured to fix a position and an orientation when mating cable management components 110*a*, 110*b*, which can facilitate coupling of the components to one another, as well as provide torsional resistance when wrapping cable around the spool 111. The alignment features 120*a-b*, 121*a-b* can also be beneficial by easing assembly of the cable management components 110*a*, 110*b* in low light conditions.

Additionally, as illustrated in FIGS. 1A and 1B, the cable management components 110*a*, 110*b* can include divider coupling features 134*a-b*, 135*a-b*, 136*a-b* configured to receive, interface with, and secure a divider for the cable management device 101 when the cable management components 110*a*, 110*b* are assembled with one another (discussed hereinafter with reference to FIGS. 5B and 5D). In one aspect, as shown with regard to divider coupling features 135*a-b*, a divider coupling feature can be located between alignment features, such as alignment features 120*a-b*, when the cable management components 110*a*, 110*b* are assembled with one another. This need not be the case, however, as illustrated by divider coupling features 134*a-b*, which are not located near any alignment features.

The cable management components 110*a*, 110*b* can also include a mounting tab 122*a*, 123*a*, 123*b* (a second mounting tab of component 110*b* is obscured from view) configured to facilitate mounting of the cable management device 101 to a support structure. The mounting tab can be disposed on the outer side of the first and/or second component 110*a*, 110*b* to receive a fastener to facilitate mounting of the cable management device 101 to the support structure. In one aspect, the mounting tab 122*a*, 123*a*, 123*b* can extend toward the hub 116*a*, 116*b* from and/or parallel to the flange 112*a*, 112*b*.

In a further aspect, the cable management components 110*a*, 110*b* can also include an opening 124*a-b*, 125*a-b*, 126*a-b*, 127*a-b* in the spooling portion 111*a*, 111*b* and/or the flange 112*a*, 112*b* to facilitate securing a cable tie to the cable management device 101 such that a cable can be secured to the cable management device 101 with the cable tie. The cable tie openings 124*a-b*, 125*a-b*, 126*a-b*, 127*a-b* can be configured to allow any number of cables or cable portions to be secured to the cable management device 101 with a cable tie. The cable tie openings 124*a-b*, 125*a-b*, 126*a-b*, 127*a-b* can also be configured such that access to the openings with a cable tie is available even when the cable management device 101 is against a support structure, such as a wall. The cable tie openings 124*a-b*, 125*a-b*, 126*a-b*, 127*a-b* can extend about a surface of the spool or spooling portions in one direction, and about a surface of the flange in another direction, as shown.

In addition, the cable management components 110*a*, 110*b* can include a cable retainer 128*b* (a cable retainer of component 110*a* is largely obscured from view) extending from the flange 112*a*, 112*b* configured to secure the cable about the spool to prevent the cable from unwinding from the cable management device 101. The cable retainer 128*b* can be configured to engage a cable along its length or a free end, such as to obstruct a free end of the cable. In one aspect, the cable retainer 128*b* can be disposed on an inner side of the flange 112*b* and can protrude inwardly over or about the spooling portion to engage the cable 103, as shown in FIG. 2. The cable retainer 128*b* can be located at an elevation relative to the spool surface, such that it engages a cable located in a first or initial row, or it can be located in an elevation relative to the spool surface, such that it engages a cable located in an upper or subsequent row.

Figure 3:
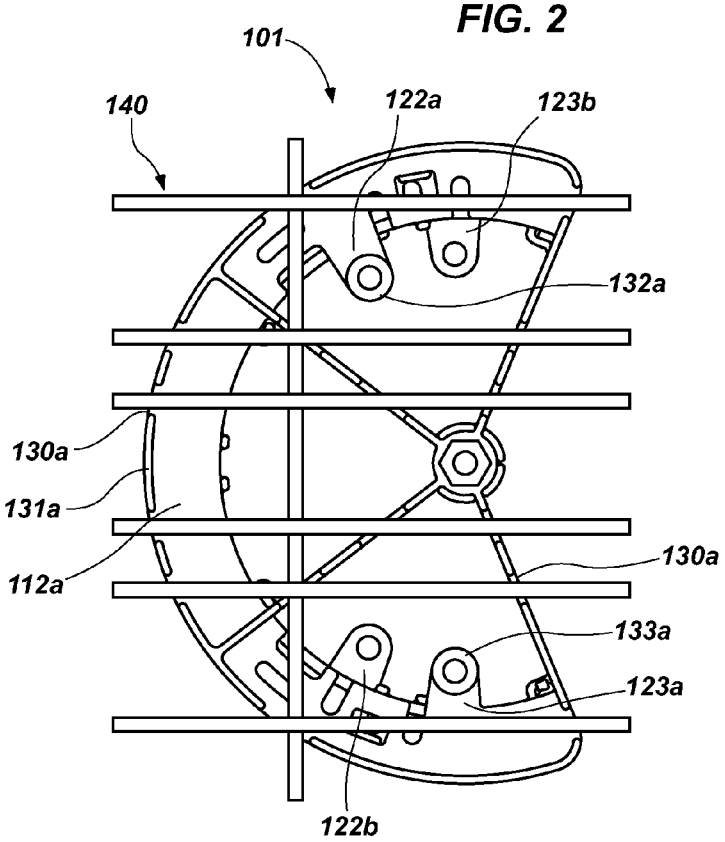
FIG. 3 is a side view of the cable management device of FIG. 1A interfacing with a wire tray in accordance with an embodiment of the present invention.

FIGS. 1A and 1B also illustrate the cable management component 110*a* having a positioning system 130*a* formed about the flange 112*a* and/or the spokes, such as spoke 114*a*. As shown in FIG. 3, the positioning system 130*a* can be configured to receive a portion of a wire tray 140 to maintain position and orientation of the cable management device 101 relative to the wire tray 140 as mounted to the wire tray 140. The positioning system 130*a* can comprise a gap, recess, notch, channel, etc. in the flange or spoke surface that can be configured to receive a portion of a wire tray 140. In one aspect, the gap, recess, notch, channel, etc. can be formed in the surface of the flange. In another aspect, the gap, recess, notch, channel, etc. can be defined by one or more protrusions extending from the flange or spoke surface. For example, the positioning system 130*a* can include a rim 131*a* formed in and extending from the flange 112*a* surface that includes a series of notches or gaps to receive portions of the wire tray 140 to facilitate mounting the cable management device 101 to the wire tray 140 in a manner that maintains position and orientation of the cable management device 101 relative to the wire tray 140. In other words, the positioning system 130*a* can be configured as a mechanical support to react to torque generated when wrapping a cable around the device 101. It should be recognized that the arrangement of wire supports forming the wire tray 140 can be of any configuration and that the positioning system 130*a* can therefore be of any suitable configuration to receive one or more portions of the wire tray 140 to maintain position and orientation of the cable management device 101 relative to the wire tray 140.

The positioning system 130*a* can also be configured to provide for stable mounting of the cable management device 101 to a flat support surface, such as a wall. For example, at least some of the protrusions 131*a* can be configured to extend to a common plane to provide stability for the cable management device 101 when supported against a wall. In a particular aspect, the mounting tab 122*a*, 123*a* can include a protrusion 132*a*, 133*a* configured to extend to the common plane to minimize bending of the mounting tab 122*a*, 123*a* when securing the cable management device 101 to the wall. Thus, the positioning system 130*a* and mounting tab 122*a*, 123*a* can facilitate mounting the cable management device 101 to a wire tray 140 or to a flat support structure, such as a wall.

FIG. 3 further illustrates a strategic placement of features on each component of the cable management device 101 to provide specific positioning and functionality when the two components are mated. For example, the mounting tabs 122*a*, 123*a* can be asymmetrically positioned such that mating with an identical component will result in a positional offset with mounting tabs 122*b*, 123*b* to allow unobstructed access to the mounting tabs 122*a*, 123*a* or the mounting tabs 122*b*, 123*b* for securing the cable management device 101 to a support structure.

Figure 4A:
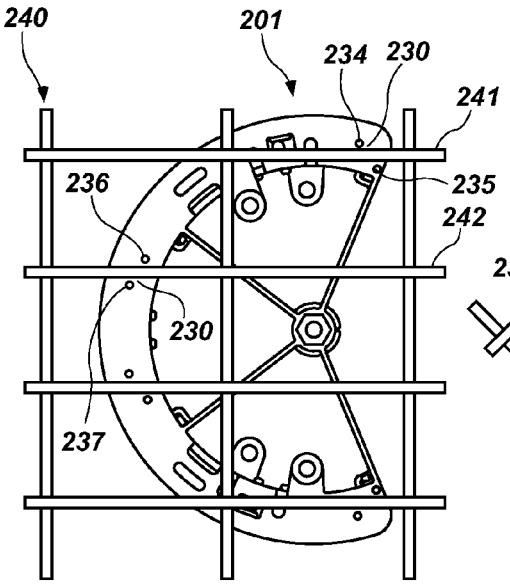
FIGS. 4A and 4B are side views of a cable management device interfacing with a wire tray in accordance with another embodiment of the present invention.
Figure 4B:
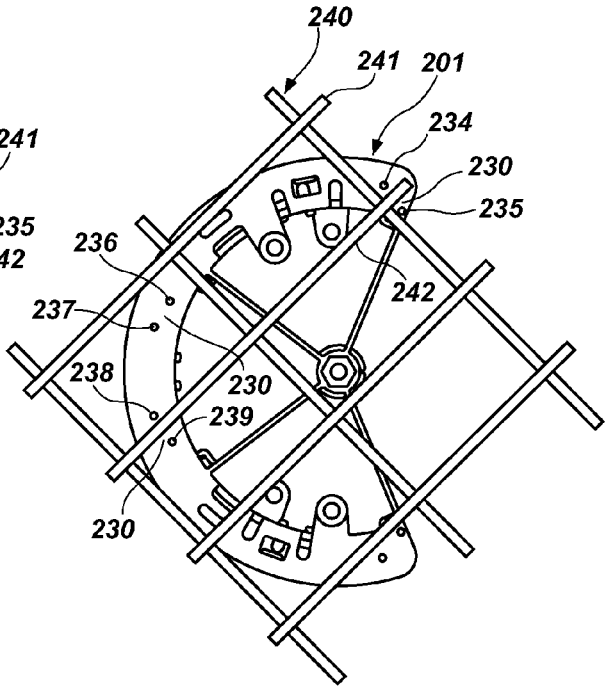

With reference to FIGS. 4A and 4B, a positioning system 230 can facilitate variable orientations of a cable management device 201 relative to a wire tray 240. In a particular aspect, the positioning system 230 can be configured to receive one or more supports of the wire tray 240 adjacent to a protrusion or in an opening between protrusions to maintain position and orientation of the cable management device 201 relative to the wire tray 240. As illustrated in FIG. 4A, for example, a wire tray support 241 is positioned in an opening between protrusions 234, 235 and wire tray support 242 is positioned in an opening between protrusions 236, 237.

FIG. 4B illustrates the cable management device 201 and the wire tray 240 in a different orientation, such that the wire tray support 241 is no longer between protrusions of the positioning system 230, but wire tray support 242 is now in the opening between protrusions 234, 235 as well as in an opening between protrusions 238, 239. Therefore, in both orientations illustrated in FIGS. 4A and 4B, the position and orientation of the cable management device 201 can be maintained relative to the wire tray 240 by the positioning system. It should be recognized that any number, combination, location, size, or other characteristic of a protrusion or opening of a positioning system can be utilized to facilitate variable orientations for the cable management device 201 relative to the wire tray 240.

FIGS. 5A-5E illustrate additional cable management device components and configurations. For example, referring to FIG. 5A, a spacer 150 is illustrated that can be used to enlarge the available spool surface for a cable management device as described herein. For example, the spacer 150 can have a spooling portion 151 and at least one coupling feature 153*a*, 153*b* operable to facilitate coupling the spacer 150 to a first component and a second component, namely between these, as described herein. In one aspect, the spooling portion 151, spokes 154, 155, and/or a hub 156 of the spacer 150 can be configured to match these respective corresponding elements of the first and second components. Thus, the spacer 150 can be configured to interface with the first component and the second component such that the respective spooling portions mate to form a spool for the cable. The spacer 150 can be utilized or removed as desired to provide a suitable spool for the cable. In one aspect, a spacer can include a flange on one or both sides to create divisions in the spool surface, which can be used to organize cables on a cable management device. Additionally, the spacer 150 can include divider coupling features similar to those discussed herein with respect to FIGS. 1A and 1B, such as divider coupling features 157*a-b*.

Figure 5A:
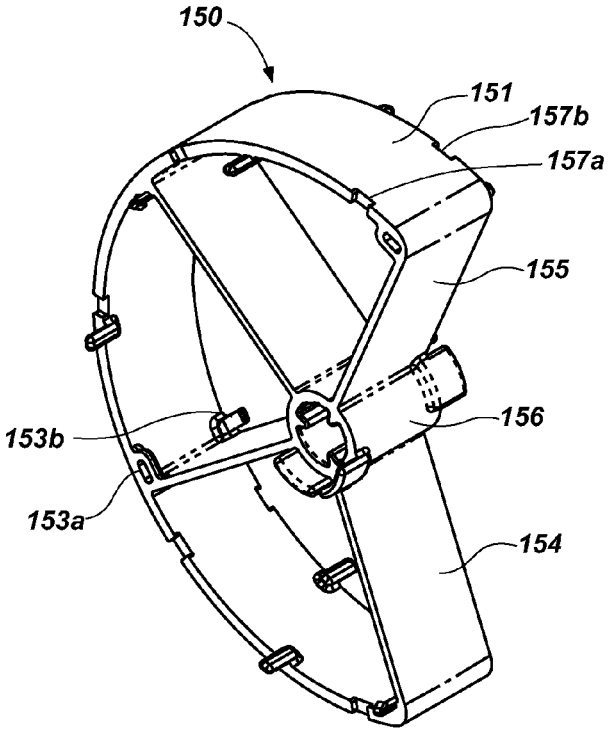
FIG. 5A is an example illustration of a spacer for a cable management device in accordance an embodiment of the present invention.
Figure 5B:
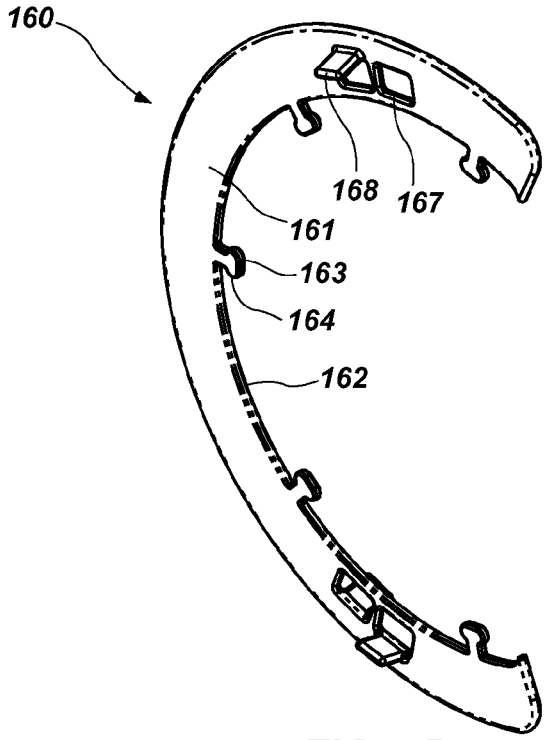
FIG. 5B is an example illustration of a divider for a cable management device in accordance an embodiment of the present invention.

FIG. 5B illustrates a divider 160 for a cable management device. The divider 160 can be configured to provide a physical barrier between portions of a cable management device. For example, the divider can include a wall portion 161 to maintain a cable in a desired area about a spooling portion. The wall portion 161 can be configured to extend away from the spooling portion and can have an inner side 162 that can substantially approximate a shape of the spooling portion. The divider 160 can include one or more tabs 163 to mate with and engage divider coupling features, as discussed hereinabove. The tab 163 can include a flange 164 or expanded portion to prevent the divider 160 from unwanted or accidental separation from a spool portion. Similar to the cable management components 110*a*, 110*b* discussed hereinabove with reference to FIGS. 1A and 1B, the divider 160 can also include one or more cable tie openings 167 to facilitate securing a cable tie to the divider 160, as well as one or more cable retainers 168 to secure a cable about a spool to prevent the cable from unwinding.

Figure 5C:
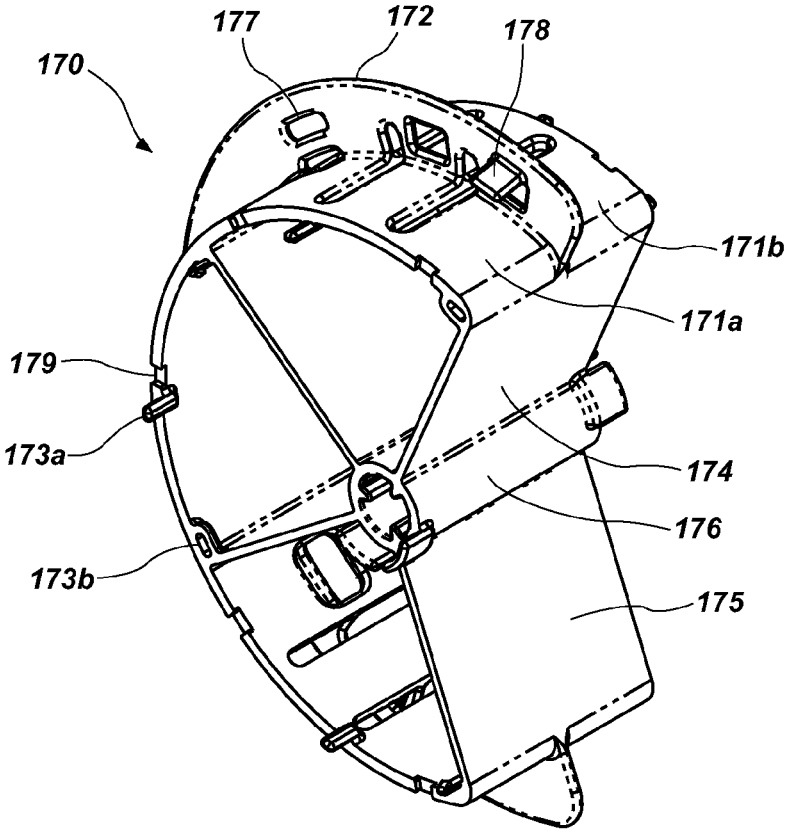
FIG. 5C is an example illustration of a combination spacer/divider for a cable management device in accordance an embodiment of the present invention.

FIG. 5C illustrates a combination spacer/divider 170 for a cable management device. The combination spacer/divider 170 can be configured to provide spool portions 171*a*, 171*b* for a cable as well as divider portion 172 to provide a physical barrier between the spool portions 171*a*, 171*b*. The divider portion 172 can be configured to extend away from the spooling portions 171*a*, 171*b* and can maintain a cable in a desired area about a cable management device. The combination spacer/divider 170 can also include one or more cable tie openings 177 to facilitate securing a cable tie to the combination spacer/divider 170, as well as one or more cable retainers 178 to secure a cable about the spooling portions 171*a*, 171*b* to prevent the cable from unwinding. As illustrated in FIG. 5C, the combination spacer/divider 170 can include features and components similar to the cable management components 110*a*, 110*b* discussed hereinabove with reference to FIGS. 1A and 1B. For example, the combination spacer/divider 170 can include at least one coupling feature 173*a*, 173*b* operable to facilitate coupling the combination spacer/divider 170 to a first component, a second component, a spacer, or another combination spacer/divider, as described herein. In one aspect, the spooling portions 171*a*, 171*b*, spokes 174, 175, and/or a hub 176 of the combination spacer/divider 170 can be configured to match these respective corresponding elements of mating components. Similarly, the combination spacer/divider 170 can include one or more divider coupling features 179 configured to receive, interface with, and secure a divider, as disclosed herein. Thus, the combination spacer/divider 170 can be configured to interface with various components to form a cable management device.

Figure 5D:
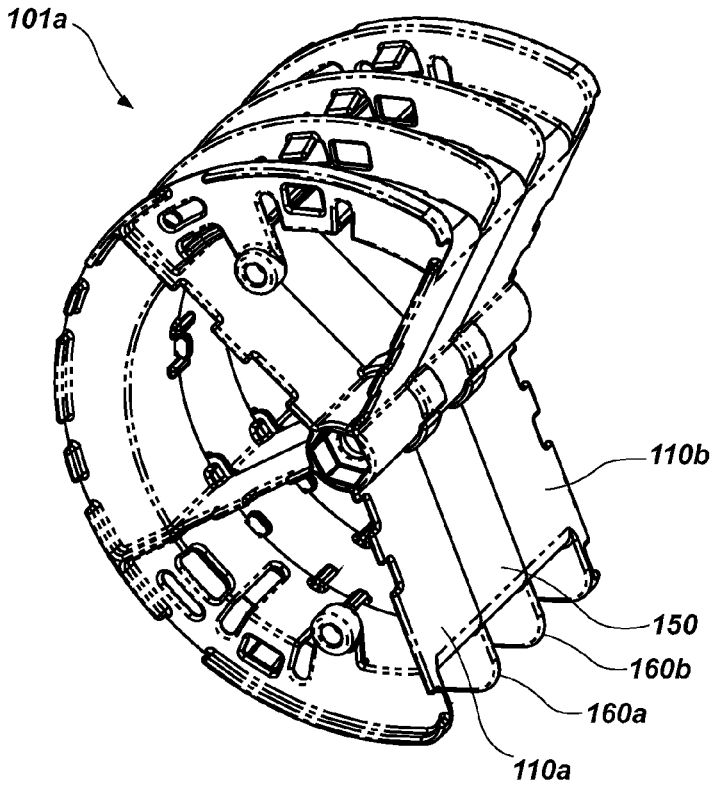
FIG. 5D is an example illustration of an assembly configuration for a cable management device utilizing a spacer and a divider in accordance an embodiment of the present invention.
Figure 5E:
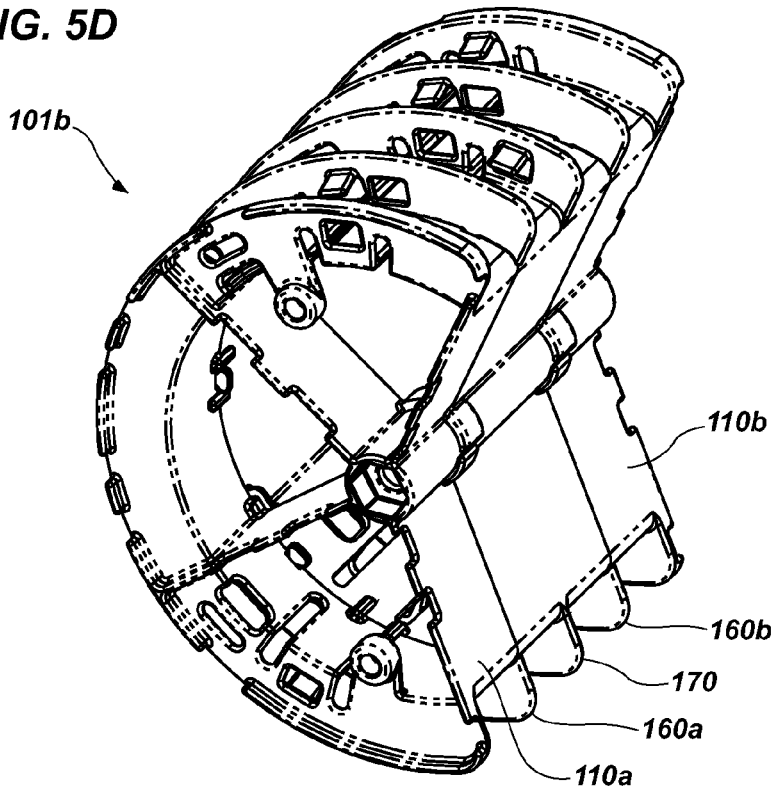
FIG. 5E is an example illustration of an assembly configuration for a cable management device utilizing a combination spacer/divider and a divider in accordance an embodiment of the present invention.

FIG. 5D illustrates an example of an assembly configuration for a cable management device 101*a* utilizing a spacer 150 and two dividers 160*a*, 160*b*. FIG. 5E illustrates another example of an assembly configuration for a cable management device 101*b* utilizing a combination spacer/divider 170 and two dividers 160*a*, 160*b*. Although the cable management devices 101*a*, 101*b* are shown having one spacer 150 or one combination spacer/divider 170 and two dividers 160*a*, 160*b*, it should be recognized that any number of spacers, combination spacers/dividers, and dividers can be included in a cable management device, in any combination.

In one aspect, available spool surface can be increased by "stacking" two or more cable management devices next to one another. The stacked cable management devices can be secured to one another with a fastener, such as by inserting a fastener to extend through each of the respective hubs of the cable management devices. In a specific aspect, the flanges of the stacked cable management devices can function to create divisions in an aggregate spool surface of the stacked devices, which can be used to organize cables wrapped around the stacked devices.

Figure 6A:
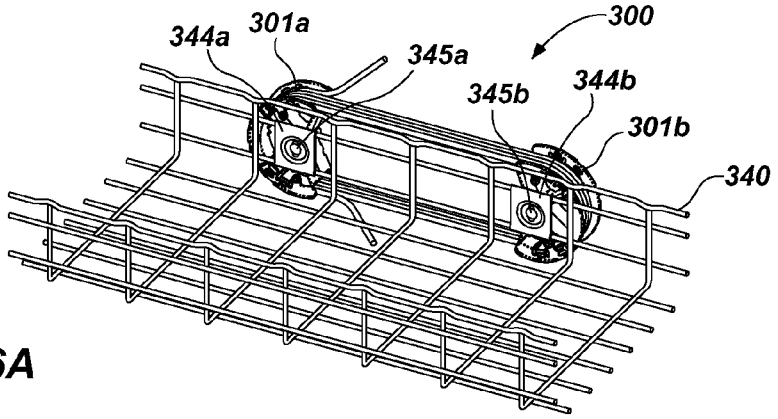
FIGS. 6A-6E illustrate cable management systems having cable management devices mounted to various support structures, in accordance with several embodiments of the present disclosure.
Figure 6B:
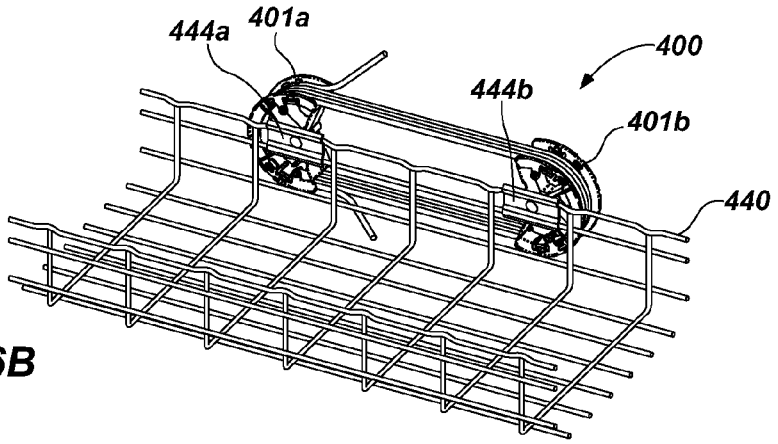
Figure 6C:
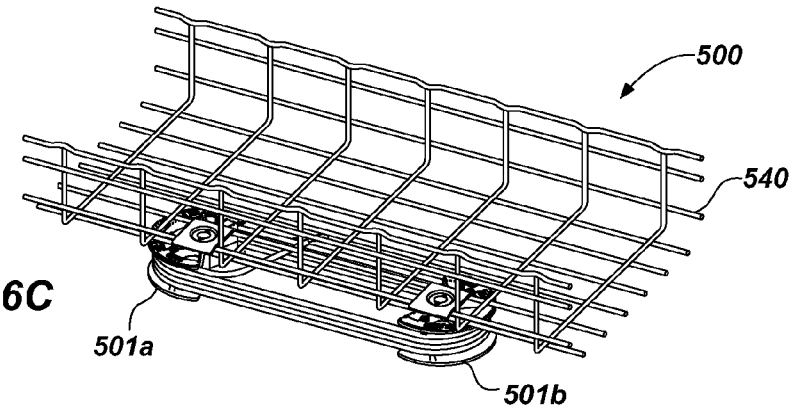
Figure 6D:
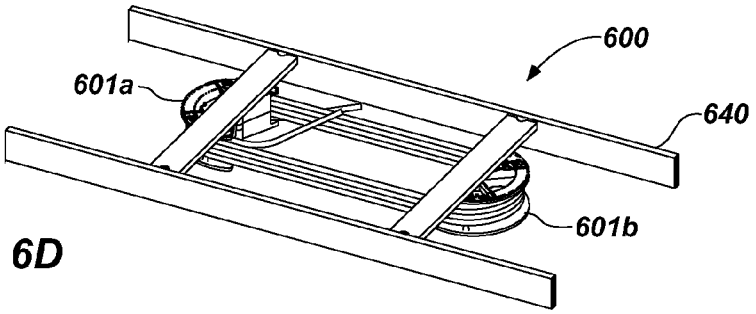
Figure 6E:
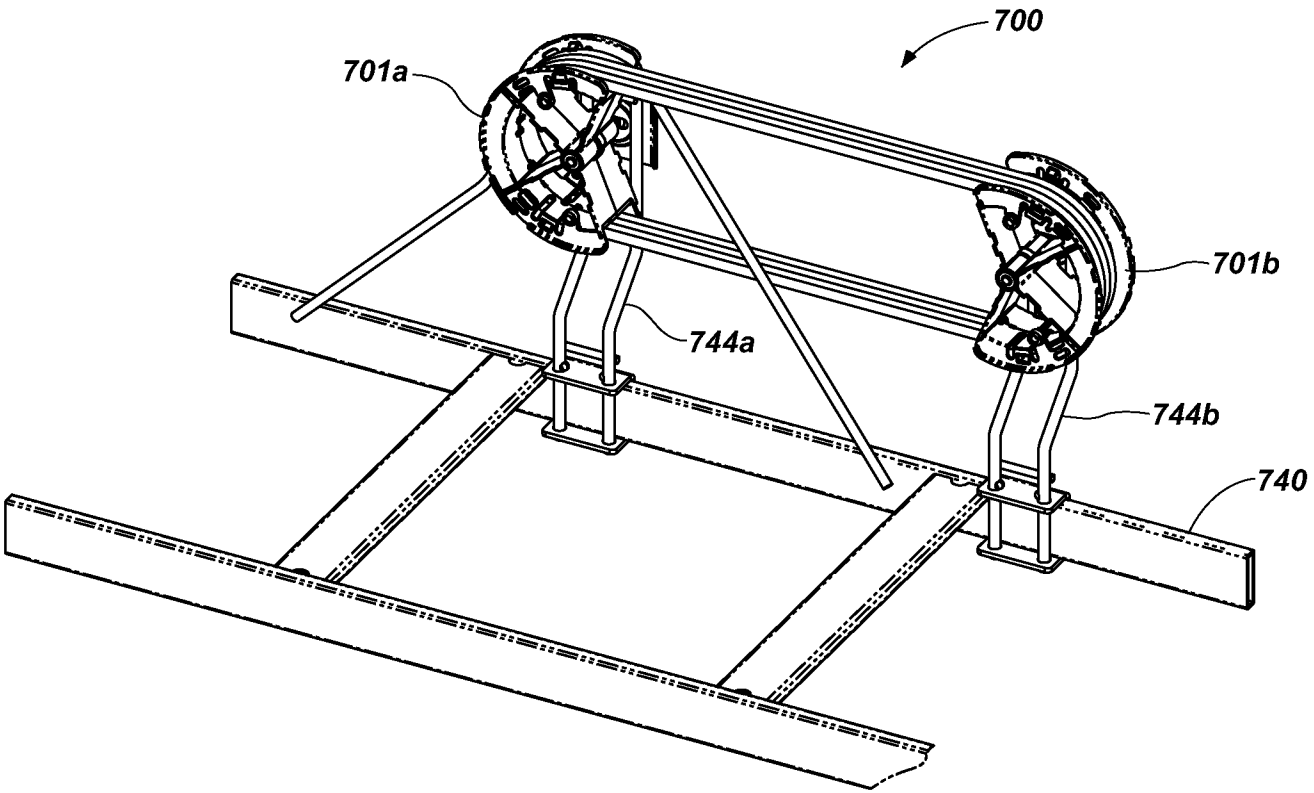

FIGS. 6A-6E illustrate cable management systems having cable management devices mounted to various support structures as well as vertical and horizontal orientations for cable management devices. For example, FIG. 6A illustrates a cable management system 300 having a pair of cable management devices 301*a*, 301*b*, as described herein, vertically mounted to a side of a wire tray 340 with mounting plates 344*a*, 344*b*. Each mounting plate 344*a*, 344*b* is configured to receive a fastener 345*a*, 345*b* that extends through the hubs of the cable management devices 301*a*, 301*b*. Thus, the cable management devices 301*a*, 301*b* can be mounted directly to a support structure without an intermediate adapter or other structure between the device and the support structure. In addition, the mounting plates 344*a*, 344*b* shown are configured to interface with and engage a pair of supports of the wire tray 340 that are spaced relatively far apart from one another. On the other hand, FIG. 6B illustrates a cable management system 400 having a pair of cable management devices 401*a*, 401*b*, as described herein, vertically mounted to a side of a wire tray 440 with mounting plates 444*a*, 444*b*. The mounting plates 444*a*, 444*b* shown are configured to interface with and engage a pair of supports of the wire tray 440 that are spaced relatively close to one another. In another aspect, FIG. 6C illustrates a cable management system 500 having a pair of cable management devices 501*a*, 501*b*, as described herein, horizontally mounted to a bottom of a wire tray 540. In still another aspect, FIG. 6D illustrates a cable management system 600 having a pair of cable management devices 601*a*, 601*b*, as described herein, horizontally mounted to a bottom of a cable runway 640. In this case, the cable management devices 601*a*, 601*b* can be mounted directly to the cable runway 640 without use of a mounting plate as with the wire tray examples. In these examples, the cable management devices are located opposite one another, and oriented such that their respective terminating spool edges (defining the spool breaks) are facing towards one another. In yet another aspect, FIG. 6E illustrates a cable management system 700 having a pair of cable management devices 701*a*, 701*b*, as described herein, vertically mounted and extending from a side of a cable runway 740. Extension brackets 744*a*, 744*b* can extend away from the cable runway 740 to vertically position the cable management devices 701*a*, 701*b* in a location that provides access to the cable runway 740.

Figure 7A:
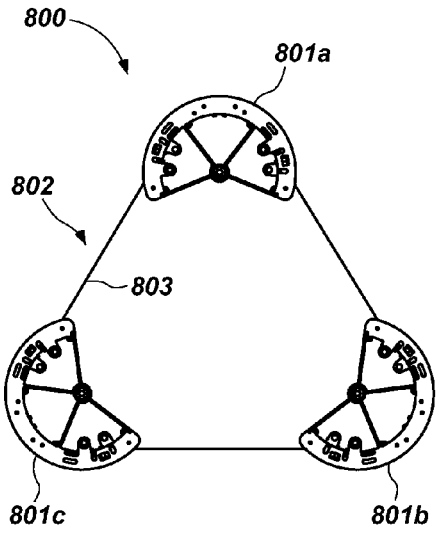
FIGS. 7A-7D illustrate cable management systems having cable management devices that can be mounted to a support structure and positioned and oriented relative to one another to provide customized cable support profiles, in accordance with several embodiments of the present disclosure.
Figure 7B:
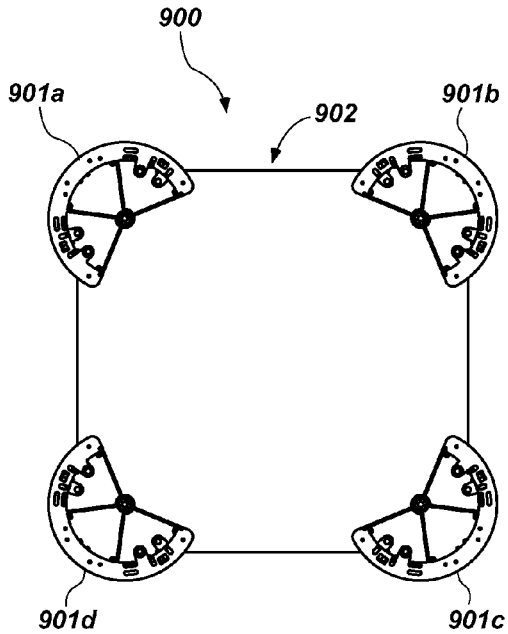
Figure 7C:
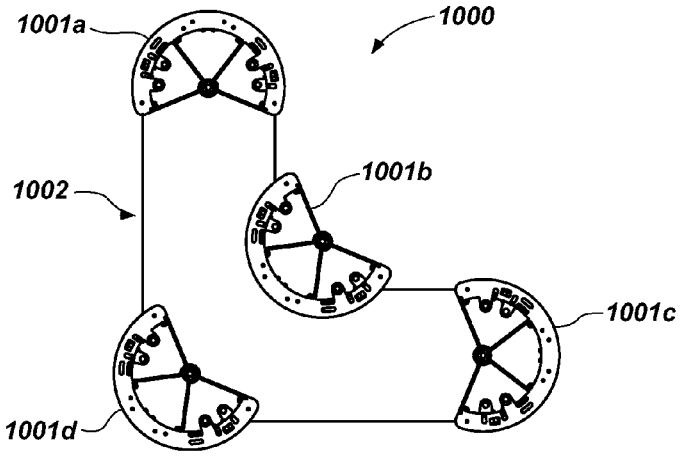
Figure 7D:
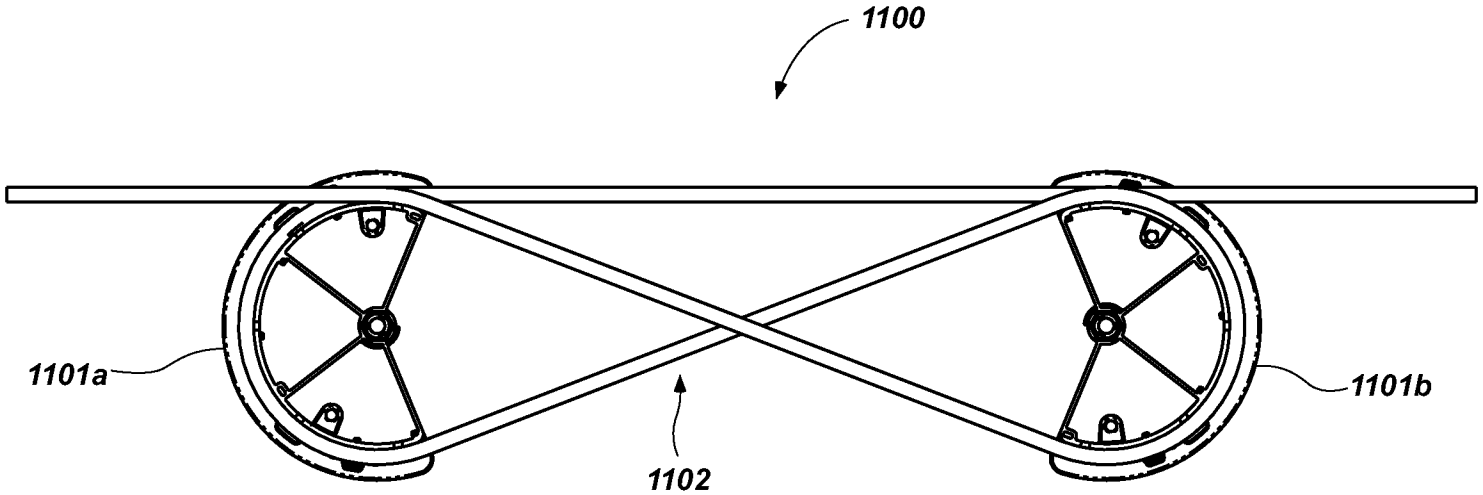

FIGS. 7A-7D illustrate cable management systems having cable management devices that can be mounted to a support structure and positioned and oriented relative to one another to provide customized cable support profiles. For example, FIG. 7A illustrates a cable management system 800 having three cable management devices 801*a*, 801*b*, 801*c*, as described herein, arranged in a "triangular" cable support profile 802. The individual devices 801*a*, 801*b*, 801*c* can be positioned and/or oriented such that the spool surfaces are configured to contact the cable 803 in a manner that maintains a proper bend radius of the cable. In another example, FIG. 7B illustrates a cable management system 900 having four cable management devices 901*a*, 901*b*, 901*c*, 901*d*, as described herein, arranged in a "rectangular" cable support profile 902. FIGS. 7A and 7B illustrate cable management devices disposed "inside" the cable support profiles. FIG. 7C, on the other hand, illustrates a cable management system 1000 having four cable management devices 1001*a*, 1001*b*, 1001*c*, 1001*d*, as described herein, arranged in an "L-shaped" cable support profile 1002, where cable management devices 1001*a*, 1001*c*, 1001*d* are disposed substantially "inside" the cable support profile and where cable management device 1001*b* is disposed substantially "outside" the cable support profile. In yet another example, FIG. 7D illustrates a cable management system 1100 having two cable management devices 1101*a*, 1101*b*, as described herein, arranged "facing" one another to provide a "figure eight" cable support profile 1102. It should be recognized that this arrangement of two cable management devices can also provide for a simple looping of cable around the perimeter of the devices as shown in FIG. 2. From these examples, it should therefore be recognized that any number of cable management devices can be arranged in any suitable configuration and/or orientation to form a customized cable support profile.

In accordance with one embodiment of the present invention, a method for facilitating cable management is disclosed. The method can comprise providing a plurality of cable management device components, each component having a spooling portion to receive a cable, and a flange extending from the spooling portion to maintain the cable on the spooling portion. Additionally, the method can comprise facilitating formation of a cable management device from two of the plurality of cable management device components, wherein two of the components are coupled to one another such that the respective spooling portions mate to form a spool for the cable.

In one aspect, the method can further comprise facilitating mounting of the cable management device to a support structure. In another aspect, the method can further comprise facilitating formation of at least a second cable management device from two of the plurality of cable management device components to provide a plurality of cable management devices, and facilitating mounting of the plurality of cable management devices to the support structure, wherein the plurality of cable management devices are positioned and oriented relative to one another to provide a customized cable support profile.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A cable management device, comprising:

a first component and a second component, each component having a spooling portion to receive a cable, a flange extending from the spooling portion to maintain the cable on the spooling portion, and a coupling feature operable to facilitate coupling of the first component and the second component, wherein the first component and the second component are configured to interface with one another such that the respective spooling portions mate to form a spool for the cable, and wherein the cable management device further comprises a divider coupleable to at least one of the first component and the second component and configured to provide a physical barrier between spooling portions of the first component and the second component.

2. The cable management device of claim 1, wherein each component further comprises an alignment feature to guide the first component and the second component into proper alignment when coupling to one another.

3. The cable management device of claim 2, wherein each component further comprises a plurality of spokes and a hub in support of the spooling portion.

4. The cable management device of claim 3, wherein the spooling portion comprises a rim, and the alignment feature is disposed proximate to an underside of the rim and configured to engage the mating rim.

5. The cable management device of claim 3, wherein the spooling portion comprises a rim, and the alignment feature is disposed proximate to the hub and is configured to engage the mating hub and at least one spoke.

6. The cable management device of claim 1, wherein the coupling feature comprises a protrusion and an opening configured to receive the protrusion.

7. The cable management device of claim 1, wherein the coupling feature is disposed proximate to the spooling portion.

8. The cable management device of claim 1, wherein each component further comprises a mounting tab configured to facilitate mounting of the cable management device to a support structure.

9. The cable management device of claim 8, wherein the mounting tab extends substantially parallel to the flange.

10. The cable management device of claim 1, wherein each component further comprises an opening in at least one of the spooling portion and the flange to facilitate securing the cable to the cable management device with a cable tie.

11. The cable management device of claim 1, wherein each component further comprises a cable retainer extending from the flange configured to obstruct the cable to prevent the cable from unwinding from the cable management device.

12. The cable management device of claim 1, wherein each component further comprises a positioning system formed about the flange to receive a portion of a wire tray to maintain position and orientation of the cable management device relative to the wire tray as mounted to the wire tray.

13. A cable management device comprising:

a first component and a second component, each component comprising:

a spooling portion to receive a cable;

a flange extending from the spooling portion to maintain the cable on the spooling portion; and a coupling feature operable to facilitate coupling of the first component and the second component, wherein the coupling feature comprises a coupling protrusion and a coupling opening configured to receive the protrusion from the other of the first and second component, wherein the first component and the second component are configured to interface with one another such that the respective spooling portions mate to form a spool for the cable, and wherein the cable management device further comprises a spacer having a second spooling portion and at least one coupling feature operable to facilitate coupling the spacer to the first component and the second component, wherein the spacer is configured to interface with the first component and the second component such that the respective spooling portions mate to increase a width of the spool, wherein the at least one coupling feature of the spacer comprises a first coupling protrusion configured to be received in the coupling opening of the first component, a second coupling protrusion configured to be received in the coupling opening of the second component, a first coupling opening configured to receive the coupling protrusion of the first component, and a second coupling opening configured to receive the coupling protrusion of the second component.

14. The cable management device of claim 13, further comprising a divider coupleable to at least one of the spacer, the first component, and the second component, and configured to provide a physical barrier between adjacent spooling portions.

15. The cable management device of claim 13, wherein each component further comprises a mounting tab configured to facilitate mounting of the cable management device to a support structure.

16. The cable management device of claim 13, wherein each component further comprises a positioning system formed about the flange to receive a portion of a wire tray to maintain position and orientation of the cable management device relative to the wire tray as mounted to the wire tray.

17. A cable management device comprising:

a first component and a second component, each component comprising:

a spooling portion to receive a cable;

a flange extending from the spooling portion to maintain the cable on the spooling portion; and a coupling feature operable to facilitate coupling of the first component and the second component, wherein the first component and the second component are configured to interface with one another such that the respective spooling portions mate to form a spool for the cable, and wherein the cable management device further comprises a combination spacer/divider having a second spooling portion;

at least one coupling feature operable to facilitate coupling the combination spacer/divider to the first component and the second component, wherein the combination spacer/divider is configured to interface with the first component and the second component such that the respective spooling portions mate to form a spool for the cable; and a divider portion to provide a physical barrier between spooling portions.

18. The cable management device of claim 17, further comprising a divider coupleable to at least one of the combination spacer/divider, the first component, and the second component, and configured to provide a physical barrier between adjacent spooling portions.

19. The cable management device of claim 17, wherein each component further comprises a mounting tab configured to facilitate mounting of the cable management device to a support structure.

20. The cable management device of claim 17, wherein each component further comprises a positioning system formed about the flange to receive a portion of a wire tray to maintain position and orientation of the cable management device relative to the wire tray as mounted to the wire tray.

* * * * *